US008359143B2

(12) United States Patent
Colwell et al.

(10) Patent No.: US 8,359,143 B2
(45) Date of Patent: Jan. 22, 2013

(54) CONTROLLING A DIGGING OPERATION OF AN INDUSTRIAL MACHINE

(75) Inventors: Joseph Colwell, Hubertus, WI (US); William Hren, Wauwatosa, WI (US); Mark Emerson, Germantown, WI (US); Michael Linstroth, Port Washington, WI (US)

(73) Assignee: Harnischfeger Technologies, Inc., Wilmington, DE (US)

( * ) Notice: Subject to any disclaimer, the term of this patent is extended or adjusted under 35 U.S.C. 154(b) by 0 days.

(21) Appl. No.: 13/472,138

(22) Filed: May 15, 2012

(65) Prior Publication Data

US 2012/0277961 A1 Nov. 1, 2012

Related U.S. Application Data

(63) Continuation of application No. 13/222,711, filed on Aug. 31, 2011.

(60) Provisional application No. 61/480,603, filed on Apr. 29, 2011.

(51) Int. Cl.
*G06F 19/00* (2006.01)

(52) U.S. Cl. ..... 701/50; 177/139; 177/141; 177/147; 702/41; 702/44

(58) Field of Classification Search ..... 701/50; 177/139, 141, 147; 702/41, 44
See application file for complete search history.

(56) References Cited

U.S. PATENT DOCUMENTS

| | | | | |
|---|---|---|---|---|
| 3,283,230 | A | 11/1966 | Davies et al. | |
| 3,463,335 | A | 8/1969 | Brownell et al. | |
| 3,867,678 | A | 2/1975 | Stoner | |
| 3,965,407 | A | 6/1976 | Stoner | |
| 3,990,161 | A | 11/1976 | Baron | |
| 4,153,166 | A | 5/1979 | Baron | |
| 4,308,489 | A | 12/1981 | Bergmann | |
| 4,677,579 | A * | 6/1987 | Radomilovich | 702/174 |
| 5,361,211 | A | 11/1994 | Lee et al. | |
| 6,072,127 | A * | 6/2000 | Oslakovic | 177/136 |
| 6,225,574 | B1 * | 5/2001 | Chang et al. | 177/139 |
| 6,385,519 | B2 | 5/2002 | Rocke | |
| 6,618,967 | B2 | 9/2003 | Satzler et al. | |

(Continued)

FOREIGN PATENT DOCUMENTS

AU 5826586 1/1987

(Continued)

OTHER PUBLICATIONS

A Dynamic Dynamometer for Testing of Mining DC Motors; Betz, R.E.; Mirzaeva, G.; Summers, T.J. Industry Applications Society Annual Meeting (IAS), 2010 IEEE; Digital Object Identifier: 10.1109/IAS.2010.5615624 Publication Year: 2010 , pp. 1-8.*

(Continued)

*Primary Examiner* — Cuong H Nguyen
(74) *Attorney, Agent, or Firm* — Michael Best & Friedrich LLP

(57) ABSTRACT

Systems, methods, devices, and computer readable media for controlling a digging operation of an industrial machine. A method includes determining a hoist bail pull associated with the industrial machine, determining a crowd torque limit value for a crowd drive based on the determined hoist bail pull of the industrial machine, and setting a crowd torque limit of the crowd drive to the crowd torque limit value to limit a torque associated with a crowd motor to the crowd torque limit value.

16 Claims, 9 Drawing Sheets

U.S. PATENT DOCUMENTS

| | | | | |
|---|---|---|---|---|
| 7,194,814 | B2 * | 3/2007 | Wilkinson et al. | 33/355 R |
| 7,356,397 | B2 | 4/2008 | Porter | |
| 7,519,462 | B2 | 4/2009 | Brown et al. | |
| 7,734,397 | B2 | 6/2010 | Peterson et al. | |
| 2005/0005464 | A1 * | 1/2005 | Wilkinson et al. | 33/355 R |
| 2007/0255471 | A1 | 11/2007 | Wallis et al. | |
| 2008/0208416 | A1 | 8/2008 | Yuet et al. | |
| 2009/0055056 | A1 | 2/2009 | Ooki et al. | |
| 2009/0118913 | A1 | 5/2009 | O'Halloran et al. | |
| 2009/0293322 | A1 | 12/2009 | Faivre et al. | |
| 2010/0017074 | A1 | 1/2010 | Verkuilen et al. | |
| 2010/0222970 | A1 | 9/2010 | Shono et al. | |
| 2011/0010059 | A1 | 1/2011 | Suzuki et al. | |
| 2011/0029279 | A1 * | 2/2011 | McAree et al. | 702/150 |
| 2011/0091308 | A1 | 4/2011 | Nichols | |

FOREIGN PATENT DOCUMENTS

| | | | |
|---|---|---|---|
| EP | 2129610 | B1 * | 7/2010 |
| WO | 2009121122 | | 10/2009 |

OTHER PUBLICATIONS

Excavating force analysis and calculation of dipper handle; Chang Lv; Zhang Jihong; Consumer Electronics, Communications and Networks (CECNet), 2011 International Conference on; Digital Object Identifier: 10.1109/CECNET.2011.5768595 Publication Year: 2011 , pp. 4068-4071.*

Modeling, simulation & fault detection in excavators with time-varying loading; Moghaddam, R.Y.; Lipsett, M.G.; Advanced Intelligent Mechatronics (AIM), 2010 IEEE/ASME International Conference on; Digital Object Identifier: 10.1109/AIM.2010.5695939 Publication Year: 2010 , pp. 779-784.*

Variable structure control of an overhead crane; Er, M.J.; Zribi, M.; Lee, K.L.; Control Applications, 1998. Proceedings of the 1998 IEEE International Conference on; vol. 1; Digital Object Identifier: 10.1109/CCA.1998.728465 Publication Year: 1998 , pp. 398-402 vol. 1.*

* cited by examiner

CONTROLLING A DIGGING OPERATION OF AN INDUSTRIAL MACHINE

RELATED APPLICATIONS

This application is a continuation of previously-filed, co-pending U.S. patent application Ser. No. 13/222,711, filed Aug. 31, 2011, which claims of benefit of U.S. Provisional Patent Application No. 61/480,603, filed Apr. 29, 2011, the entire contents of both of which are incorporated herein by reference.

BACKGROUND

This invention relates to controlling a digging operation of an industrial machine, such as an electric rope or power shovel.

SUMMARY

Industrial machines, such as electric rope or power shovels, draglines, etc., are used to execute digging operations to remove material from, for example, a bank of a mine. In difficult mining conditions (e.g., hard-toe conditions), crowding out a dipper handle (i.e., translating the dipper handle away from the industrial machine) to impact the bank can result in a dipper abruptly stopping. The abrupt stop of the dipper can then result in boom jacking Boom jacking is a kick back of the entire boom due to excess crowd reaction forces. The boom jacking or kick back caused by the dipper abruptly stopping results in the industrial machine tipping in a rearward direction (i.e., a tipping moment or center-of-gravity ["CG"] excursion away from the bank). Such tipping moments introduce cyclical stresses on the industrial machine which can cause weld cracking and other strains. The degree to which the industrial machine is tipped in either the forward or rearward directions impacts the structural fatigue that the industrial machine experiences. Limiting the maximum forward and/or rearward tipping moments and CG excursions of the industrial machine can thus increase the operational life of the industrial machine.

As such, the invention provides for the control of an industrial machine such that the crowd and hoist forces used during a digging operation are controlled to prevent or limit the forward and/or rearward tipping moments of the industrial machine. For example, the amount of CG excursion is reduced in order to reduce the structural fatigue on the industrial machine (e.g., structural fatigue on a mobile base, a turntable, a machinery deck, a lower end, etc.) and increase the operational life of the industrial machine. The crowd forces (e.g., crowd torque or a crowd torque limit) are controlled with respect to the hoist forces (e.g., a hoist bail pull) such that the crowd torque or the crowd torque limit is set based on a level of hoist bail pull. Such control limits the crowd torque that can be applied early in a digging operation, and gradually increases the crowd torque that can be applied through the digging operation as the level of hoist bail pull increases. Additionally, as a dipper of the industrial machine impacts a bank, a maximum allowable regeneration or retract torque is increased (e.g., beyond a normal or standard operational value) based on a determined acceleration of a component of the industrial machine (e.g., the dipper, a dipper handle, etc.). Controlling the operation of the industrial machine in such a manner during a digging operation limits or eliminates both static and dynamic rearward tipping moments and CG excursions that can have adverse effects on the operational life of the industrial machine. Forward and rearward static tipping moments are related to, for example, operational characteristics of the industrial machine such as applied hoist and crowd torques. Forward and rearward dynamic tipping moments are related to momentary forces on, or characteristics of, the industrial machine that result from, for example, the dipper impacting the bank, etc.

In one embodiment, the invention provides a method of controlling a digging operation of an industrial machine. The industrial machine includes a dipper handle and a crowd motor drive. The method includes determining an angle of the dipper handle, comparing the angle of the dipper handle to one or more dipper handle angle limits, determining a hoist bail pull, and comparing the hoist bail pull to one or more hoist bail pull limits. The method also includes setting a crowd torque limit for the crowd motor drive based on the comparison of the angle of the dipper handle to the one or more dipper handle angle limits and the comparison of the hoist bail pull to the one or more hoist bail pull limits.

In another embodiment, the invention provides an industrial machine that includes a dipper handle, a crowd motor drive, and a controller. The dipper handle is connected to a dipper. The crowd motor drive is configured to provide one or more control signals to a crowd motor, and the crowd motor is operable to provide a force to the dipper handle to move the dipper handle toward or away from a bank. The controller is connected to the crowd motor drive and is configured to determine an angle of the dipper handle, compare the angle of the dipper handle to one or more dipper handle angle limits, determine a hoist bail pull, and compare the hoist bail pull to one or more hoist bail pull limits. The controller is also configured to set a crowd torque limit for the crowd motor drive based on the comparison of the angle of the dipper handle to the one or more dipper handle angle limits and the comparison of the hoist bail pull to the one or more hoist bail pull limits.

In another embodiment, the invention provides a method of controlling a digging operation of an industrial machine. The method includes determining a hoist bail pull associated with the industrial machine, determining a crowd torque limit value for a crowd drive based on the determined hoist bail pull of the industrial machine, and setting a crowd torque limit of the crowd drive to the crowd torque limit value to limit a torque associated with a crowding operation to the crowd torque limit value.

Other aspects of the invention will become apparent by consideration of the detailed description and accompanying drawings.

DETAILED DESCRIPTION

Figure 1:
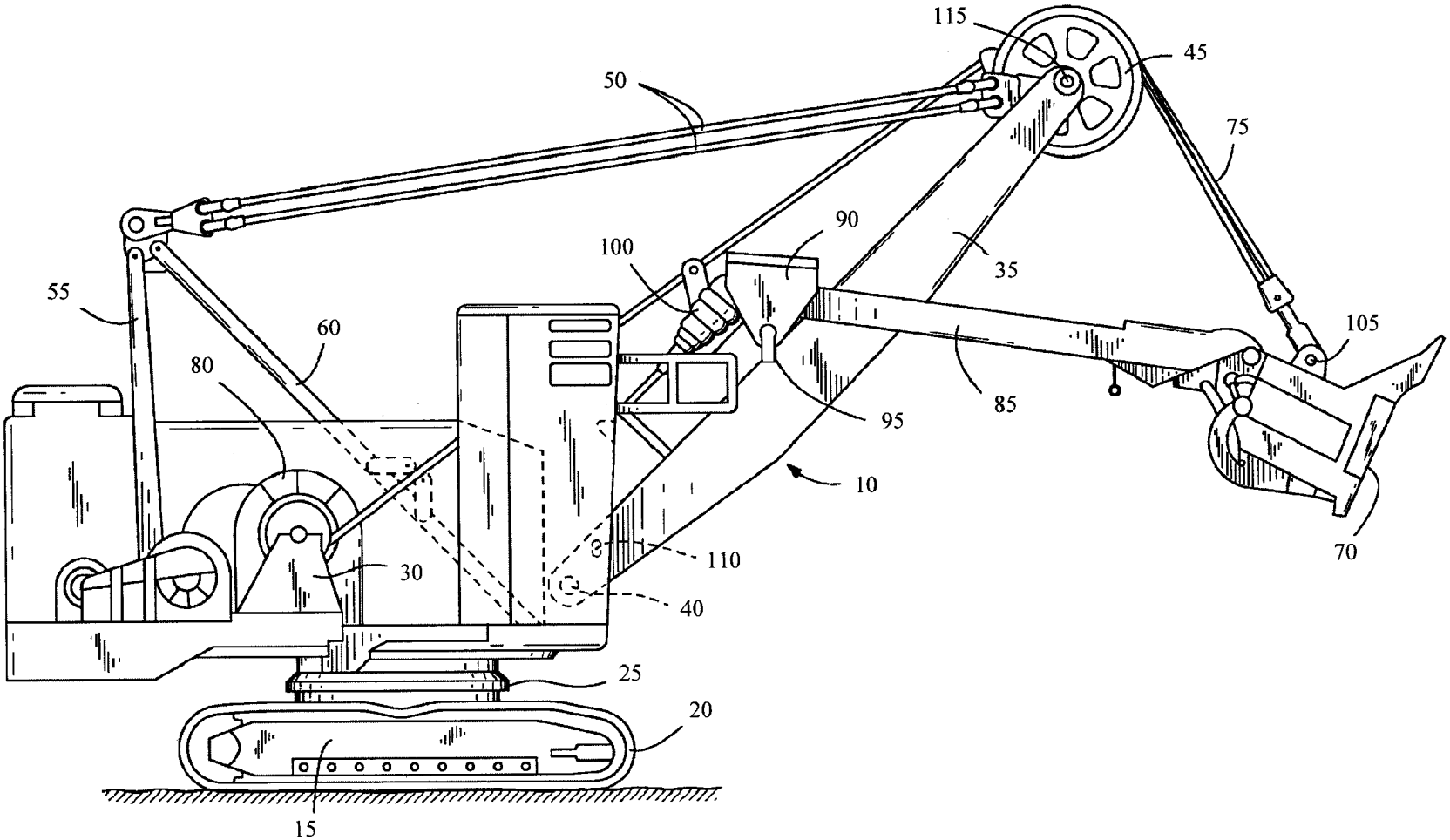
FIG. 1 illustrates an industrial machine according to an embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical connections or couplings, whether direct or indirect. Also, electronic communications and notifications may be performed using any known means including direct connections, wireless connections, etc.

It should be noted that a plurality of hardware and software based devices, as well as a plurality of different structural components may be utilized to implement the invention. Furthermore, and as described in subsequent paragraphs, the specific configurations illustrated in the drawings are intended to exemplify embodiments of the invention and that other alternative configurations are possible. The terms "processor" "central processing unit" and "CPU" are interchangeable unless otherwise stated. Where the terms "processor" or "central processing unit" or "CPU" are used as identifying a unit performing specific functions, it should be understood that, unless otherwise stated, those functions can be carried out by a single processor, or multiple processors arranged in any form, including parallel processors, serial processors, tandem processors or cloud processing/cloud computing configurations.

The invention described herein relates to systems, methods, devices, and computer readable media associated with the dynamic control of one or more crowd torque limits of an industrial machine based on a hoisting force or hoist bail pull of the industrial machine. The industrial machine, such as an electric rope shovel or similar mining machine, is operable to execute a digging operation to remove a payload (i.e. material) from a bank. As the industrial machine is digging into the bank, the forces on the industrial machine caused by the impact of a dipper with the bank or the relative magnitudes of crowd torque and hoist bail pull can produce a tipping moment and center-of-gravity ("CG") excursion on the industrial machine in a rearward direction. The magnitude of the CG excursion is dependent on, for example, a ratio of an allowable crowd torque or crowd torque limit to a level of hoist bail pull, as well as the ability of the industrial machine to dissipate the kinetic energy of one or more crowd motors following the impact of the dipper with the bank. As a result of the CG excursion, the industrial machine experiences cyclical structural fatigue and stresses that can adversely affect the operational life of the industrial machine. In order to reduce the rearward tipping moments and the range of CG excursion in the rearward direction that are experienced by the industrial machine, a controller of the industrial machine dynamically limits crowd torque to an optimal value relative to the level of hoist bail pull and also dynamically increases a maximum allowable retract torque or crowd retract torque (e.g., beyond a standard operational value) based on a determined acceleration of a component of the industrial machine (e.g., the dipper, a dipper handle, etc.). Controlling the operation of the industrial machine in such a manner during a digging operation reduces or eliminates the static and dynamic rearward tipping moments and CG excursions of the industrial machine.

Although the invention described herein can be applied to, performed by, or used in conjunction with a variety of industrial machines (e.g., a rope shovel, a dragline, AC machines, DC machines, hydraulic machines, etc.), embodiments of the invention described herein are described with respect to an electric rope or power shovel, such as the power shovel 10 shown in FIG. 1. The shovel 10 includes a mobile base 15, drive tracks 20, a turntable 25, a machinery deck 30, a boom 35, a lower end 40, a sheave 45, tension cables 50, a back stay 55, a stay structure 60, a dipper 70, one or more hoist ropes 75, a winch drum 80, dipper arm or handle 85, a saddle block 90, a pivot point 95, a transmission unit 100, a bail pin 105, an inclinometer 110, and a sheave pin 115. In some embodiments, the invention can be applied to an industrial machine including, for example, a single legged handle, a stick (e.g., a tubular stick), or a hydraulic cylinder actuating a crowd motion.

The mobile base 15 is supported by the drive tracks 20. The mobile base 15 supports the turntable 25 and the machinery deck 30. The turntable 25 is capable of 360-degrees of rotation about the machinery deck 30 relative to the mobile base 15. The boom 35 is pivotally connected at the lower end 40 to the machinery deck 30. The boom 35 is held in an upwardly and outwardly extending relation to the deck by the tension cables 50 which are anchored to the back stay 55 of the stay structure 60. The stay structure 60 is rigidly mounted on the machinery deck 30, and the sheave 45 is rotatably mounted on the upper end of the boom 35.

The dipper 70 is suspended from the boom 35 by the hoist rope(s) 75. The hoist rope 75 is wrapped over the sheave 45 and attached to the dipper 70 at the bail pin 105. The hoist rope 75 is anchored to the winch drum 80 of the machinery deck 30. As the winch drum 80 rotates, the hoist rope 75 is paid out to lower the dipper 70 or pulled in to raise the dipper 70. The dipper handle 85 is also rigidly attached to the dipper 70. The dipper handle 85 is slidably supported in a saddle block 90, and the saddle block 90 is pivotally mounted to the boom 35 at the pivot point 95. The dipper handle 85 includes a rack tooth formation thereon which engages a drive pinion mounted in the saddle block 90. The drive pinion is driven by an electric motor and transmission unit 100 to extend or retract the dipper arm 85 relative to the saddle block 90.

An electrical power source is mounted to the machinery deck 30 to provide power to one or more hoist electric motors for driving the winch drum 80, one or more crowd electric motors for driving the saddle block transmission unit 100, and one or more swing electric motors for turning the turntable 25. Each of the crowd, hoist, and swing motors can be driven by its own motor controller or drive in response to control signals from a controller, as described below.

Figure 2:
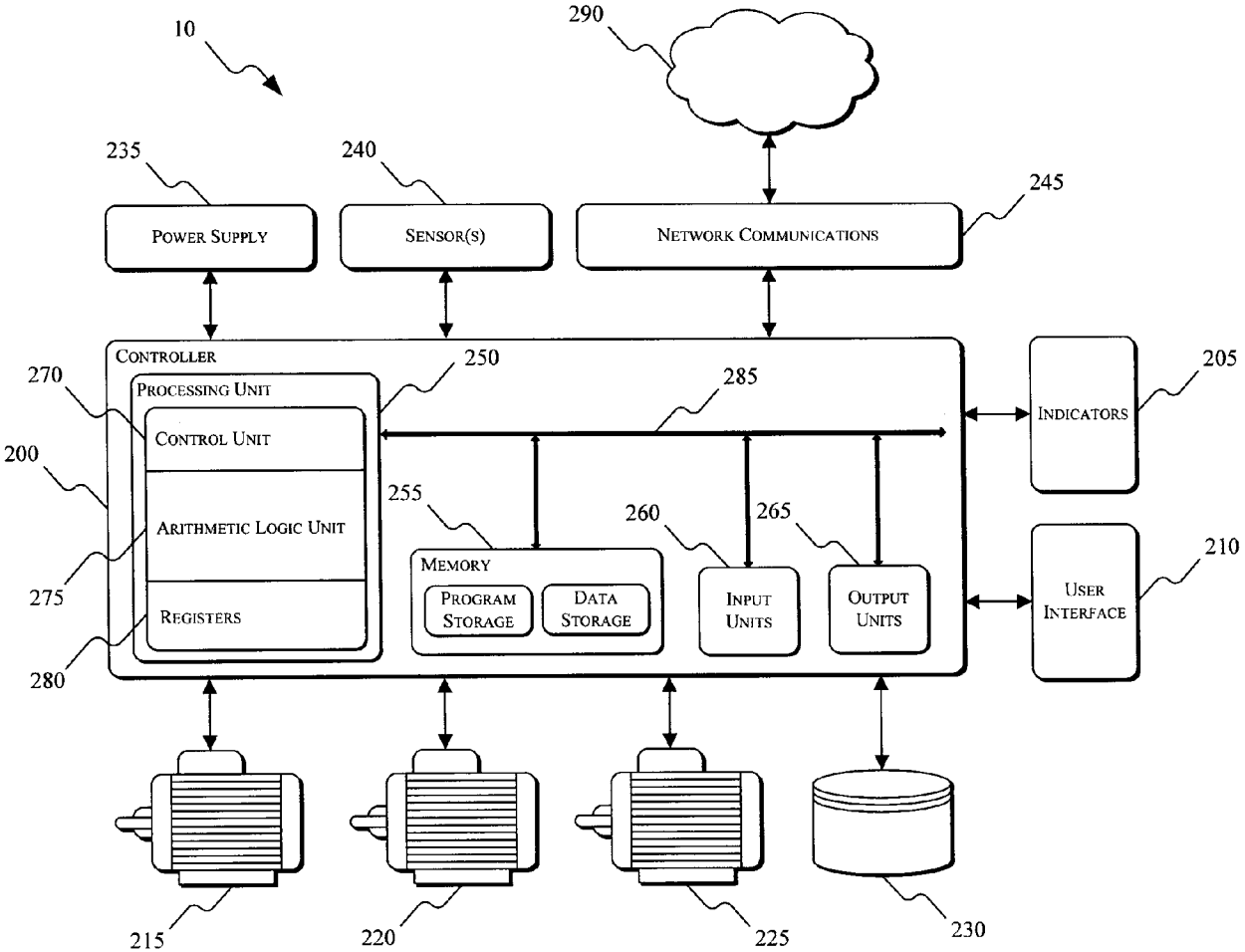
FIG. 2 illustrates a controller for an industrial machine according to an embodiment of the invention.

FIG. 2 illustrates a controller 200 associated with the power shovel 10 of FIG. 1. The controller 200 is electrically and/or communicatively connected to a variety of modules or components of the shovel 10. For example, the illustrated controller 200 is connected to one or more indicators 205, a user interface module 210, one or more hoist motors and hoist motor drives 215, one or more crowd motors and crowd motor drives 220, one or more swing motors and swing motor drives 225, a data store or database 230, a power supply module 235, one or more sensors 240, and a network communications module 245. The controller 200 includes combinations of hardware and software that are operable to, among other things, control the operation of the power shovel 10, control the position of the boom 35, the dipper arm 85, the dipper 70, etc., activate the one or more indicators 205 (e.g., a liquid crystal display ["LCD"]), monitor the operation of the shovel 10, etc. The one or more sensors 240 include, among other things, a loadpin strain gauge, the inclinometer 110, gantry pins, one or more motor field modules, etc. The loadpin strain gauge includes, for example, a bank of strain gauges positioned in an x-direction (e.g., horizontally) and a bank of strain gauges positioned in a y-direction (e.g., vertically) such that a resultant force on the loadpin can be determined. In some embodiments, a crowd drive other than a crowd motor drive can be used (e.g., a crowd drive for a single legged handle, a stick, a hydraulic cylinder, etc.).

In some embodiments, the controller 200 includes a plurality of electrical and electronic components that provide power, operational control, and protection to the components and modules within the controller 200 and/or shovel 10. For example, the controller 200 includes, among other things, a processing unit 250 (e.g., a microprocessor, a microcontroller, or another suitable programmable device), a memory 255, input units 260, and output units 265. The processing unit 250 includes, among other things, a control unit 270, an arithmetic logic unit ("ALU") 275, and a plurality of registers 280 (shown as a group of registers in FIG. 2), and is implemented using a known computer architecture, such as a modified Harvard architecture, a von Neumann architecture, etc. The processing unit 250, the memory 255, the input units 260, and the output units 265, as well as the various modules connected to the controller 200 are connected by one or more control and/or data buses (e.g., common bus 285). The control and/or data buses are shown generally in FIG. 2 for illustrative purposes. The use of one or more control and/or data buses for the interconnection between and communication among the various modules and components would be known to a person skilled in the art in view of the invention described herein. In some embodiments, the controller 200 is implemented partially or entirely on a semiconductor (e.g., a field-programmable gate array ["FPGA"] semiconductor) chip, such as a chip developed through a register transfer level ("RTL") design process.

The memory 255 includes, for example, a program storage area and a data storage area. The program storage area and the data storage area can include combinations of different types of memory, such as read-only memory ("ROM"), random access memory ("RAM") (e.g., dynamic RAM ["DRAM"], synchronous DRAM ["SDRAM"], etc.), electrically erasable programmable read-only memory ("EEPROM"), flash memory, a hard disk, an SD card, or other suitable magnetic, optical, physical, or electronic memory devices. The processing unit 250 is connected to the memory 255 and executes software instructions that are capable of being stored in a RAM of the memory 255 (e.g., during execution), a ROM of the memory 255 (e.g., on a generally permanent basis), or another non-transitory computer readable medium such as another memory or a disc. Software included in the implementation of the shovel 10 can be stored in the memory 255 of the controller 200. The software includes, for example, firmware, one or more applications, program data, filters, rules, one or more program modules, and other executable instructions. The controller 200 is configured to retrieve from memory and execute, among other things, instructions related to the control processes and methods described herein. In other constructions, the controller 200 includes additional, fewer, or different components.

The network communications module 245 is configured to connect to and communicate through a network 290. In some embodiments, the network is, for example, a wide area network ("WAN") (e.g., a TCP/IP based network, a cellular network, such as, for example, a Global System for Mobile Communications ["GSM"] network, a General Packet Radio Service ["GPRS"] network, a Code Division Multiple Access ["CDMA"] network, an Evolution-Data Optimized ["EV-DO"] network, an Enhanced Data Rates for GSM Evolution ["EDGE"] network, a 3GSM network, a 4GSM network, a Digital Enhanced Cordless Telecommunications ["DECT"] network, a Digital AMPS ["IS-136/TDMA"] network, or an Integrated Digital Enhanced Network ["iDEN"] network, etc.).

In other embodiments, the network 290 is, for example, a local area network ("LAN"), a neighborhood area network ("NAN"), a home area network ("HAN"), or personal area network ("PAN") employing any of a variety of communications protocols, such as Wi-Fi, Bluetooth, ZigBee, etc. Communications through the network 290 by the network communications module 245 or the controller 200 can be protected using one or more encryption techniques, such as those techniques provided in the IEEE 802.1 standard for port-based network security, pre-shared key, Extensible Authentication Protocol ("EAP"), Wired Equivalency Privacy ("WEP"), Temporal Key Integrity Protocol ("TKIP"), Wi-Fi Protected Access ("WPA"), etc. The connections between the network communications module 245 and the network 290 are, for example, wired connections, wireless connections, or a combination of wireless and wired connections. Similarly, the connections between the controller 200 and the network 290 or the network communications module 245 are wired connections, wireless connections, or a combination of wireless and wired connections. In some embodiments, the controller 200 or network communications module 245 includes one or more communications ports (e.g., Ethernet, serial advanced technology attachment ["SATA"], universal serial bus ["USB"], integrated drive electronics ["IDE"], etc.) for transferring, receiving, or storing data associated with the shovel 10 or the operation of the shovel 10.

The power supply module 235 supplies a nominal AC or DC voltage to the controller 200 or other components or modules of the shovel 10. The power supply module 235 is powered by, for example, a power source having nominal line voltages between 100V and 240V AC and frequencies of approximately 50-60 Hz. The power supply module 235 is also configured to supply lower voltages to operate circuits and components within the controller 200 or shovel 10. In other constructions, the controller 200 or other components and modules within the shovel 10 are powered by one or more batteries or battery packs, or another grid-independent power source (e.g., a generator, a solar panel, etc.).

The user interface module 210 is used to control or monitor the power shovel 10. For example, the user interface module 210 is operably coupled to the controller 200 to control the position of the dipper 70, the position of the boom 35, the position of the dipper handle 85, the transmission unit 100, etc. The user interface module 210 includes a combination of digital and analog input or output devices required to achieve a desired level of control and monitoring for the shovel 10. For example, the user interface module 210 includes a display (e.g., a primary display, a secondary display, etc.) and input devices such as touch-screen displays, a plurality of knobs, dials, switches, buttons, etc. The display is, for example, a liquid crystal display ("LCD"), a light-emitting diode ("LED") display, an organic LED ("OLED") display, an electroluminescent display ("ELD"), a surface-conduction electron-emitter display ("SED"), a field emission display ("FED"), a thin-film transistor ("TFT") LCD, etc. The user interface module 210 can also be configured to display conditions or data associated with the power shovel 10 in real-time or substantially real-time. For example, the user interface module 210 is configured to display measured electrical characteristics of the power shovel 10, the status of the power shovel 10, the position of the dipper 70, the position of the dipper handle 85, etc. In some implementations, the user interface module 210 is controlled in conjunction with the one or more indicators 205 (e.g., LEDs, speakers, etc.) to provide visual or auditory indications of the status or conditions of the power shovel 10.

Figure 3:
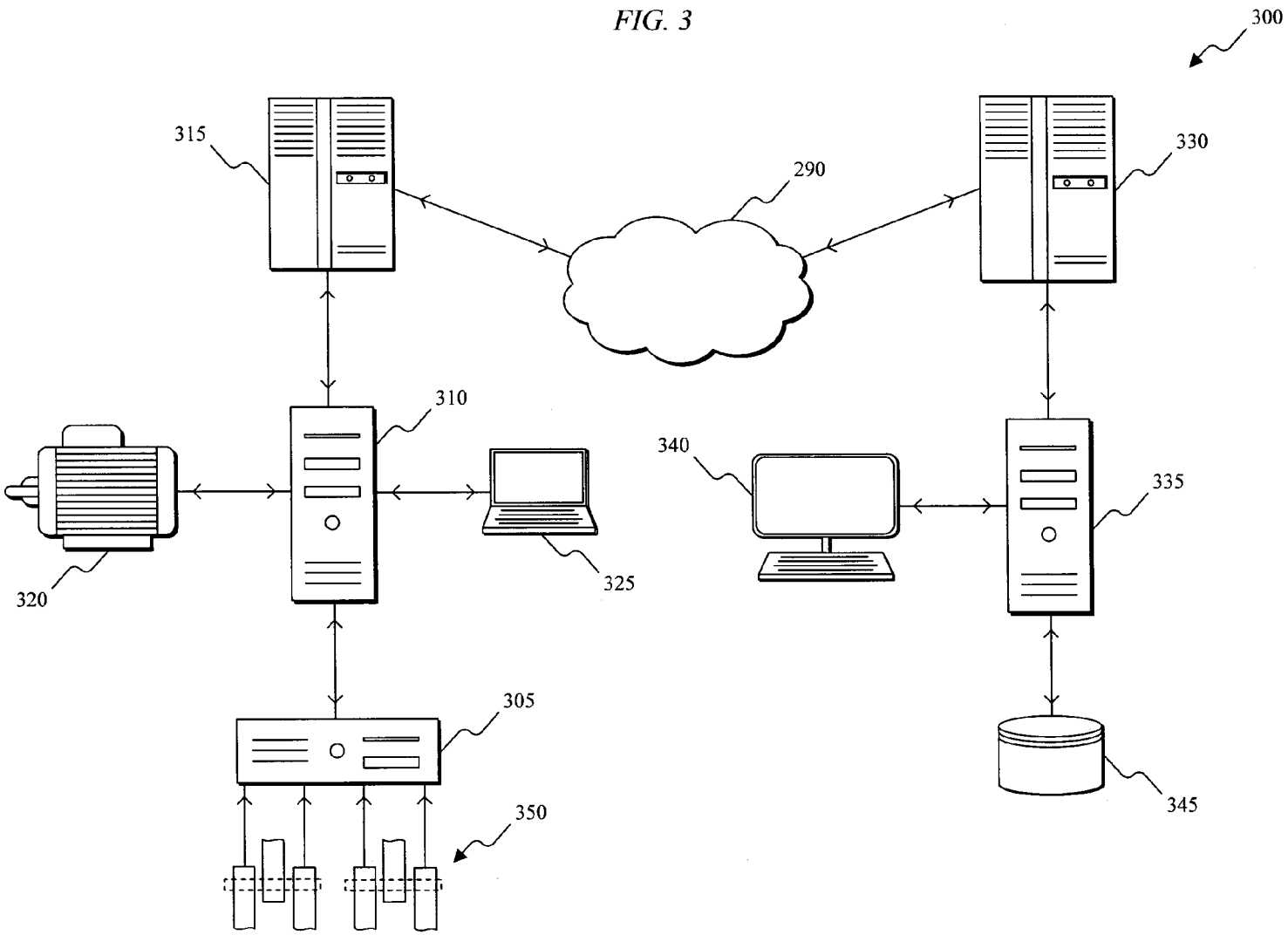
FIG. 3 illustrates a data logging system for an industrial machine according to an embodiment of the invention.

Information and data associated with the shovel 10 described above can also be stored, logged, processed, and analyzed to implement the control methods and processes described herein, or to monitor the operation and performance of the shovel 10 over time. For example, FIG. 3 illustrates a data logging and monitoring system 300 for the shovel 10. The system includes a data acquisition ("DAQ") module 305, a control device 310 (e.g., the controller 200), a data logger or recorder 315, a drive device 320, a first user interface 325, the network 290, a data center 330 (e.g., a relational database), a remote computer or server 335, a second user interface 340, and a reports database 345. The DAQ module 305 is configured to, for example, receive analog signals from one or more load pins (e.g., gantry load pins 350), convert the analog signals to digital signals, and pass the digital signals to the control device 310 for processing. The control device 310 also receives signals from the drive device 320. The drive device in the illustrated embodiment is a motor and motor drive 320 (e.g., a hoist motor and/or drive, a crowd motor and/or drive, a swing motor and/or drive, etc.) that provides information to the control device 310 related to, among other things, motor RPM, motor current, motor voltage, motor power, etc. In other embodiments, the drive device 320 is one or more operator controls in an operator cab of the shovel 10 (e.g., a joystick). The control device 310 is configured to use the information and data provided by the DAQ module 305 and the drive device 320, as well as other sensors and monitoring devices associated with the operation of the shovel 10, to determine, for example, a tipping moment of the shovel 10 (e.g., forward or reverse), a CG excursion (i.e., a translation distance of the CG), power usage (e.g., tons/kilowatt-hour), tons of material moved per hour, cycle times, fill factors, payload, dipper handle angle, dipper position, etc. In some embodiments, an industrial machine monitoring and control system for gathering, processing, analyzing, and logging information and data associated with the shovel 10, such as the P&H® Centurion® system produced and sold by P&H Mining Equipment, Milwaukee, Wis.

The first user interface 325 can be used to monitor the information and data received by the control device 310 in real-time or access information stored in the data logger or recorder 315. The information gathered, calculated, and/or determined by the control device 310 is then provided to the data logger or recorder 315. The data logger or recorder 315, the control device 310, the drive device 320, and the DAQ module 305 are, in the illustrated embodiment, contained within the shovel 10. In other embodiments, one or more of these devices can be located remotely from the shovel 10. The tipping moment of the shovel 10 (e.g., forward or reverse), the CG excursion (i.e., a translation distance of the CG), power usage (e.g., tons/kilowatt-hour), tons of material moved per hour, cycle times, fill factors, etc., determined by the control device 310 can also be used by the control device 310 during the implementation of the control methods and processes described herein (e.g., controlling the digging operation).

The data logger or recorder 315 is configured to store the information from the control device 310 and provide the stored information to the remote datacenter 330 for further storage and processing. For example, the data logger or recorder 315 provides the stored information through the network 290 to the datacenter 330. The network 290 was described above with respect to FIG. 2. In other embodiments, the data from the data logger or recorder 315 can be manually transferred to the datacenter 330 using one or more portable storage devices (e.g., a universal serial bus ["USB"] flash drive, a secure digital ["SD"] card, etc.). The datacenter 330 stores the information and data received through the network 290 from the data logger or recorder 315. The information and data stored in the datacenter 330 can be accessed by the remote computer or server 335 for processing and analysis. For example, the remote computer or server 335 is configured to process and analyze the stored information and data by executing instructions associated with a numerical computing environment, such as MATLAB®. The processed and analyzed information and data can be compiled and output to the reports database 345 for storage. For example, the reports database 345 can store reports of the information and data from the datacenter 330 based on, among other criteria, hour, time of day, day, week, month, year, operation, location, component, work cycle, dig cycle, operator, mined material, bank conditions (e.g., hard toe), payload, etc. The reports stored in the reports database 345 can be used to determine the effects of certain shovel operations on the shovel 10, monitor the operational life and damage to the shovel 10, determine trends in productivity, etc. The second user interface 340 can be used to access the information and data stored in the datacenter 330, manipulate the information and data using the numerical computing environment, or access one or more reports stored in the reports database 345.

Figure 4:
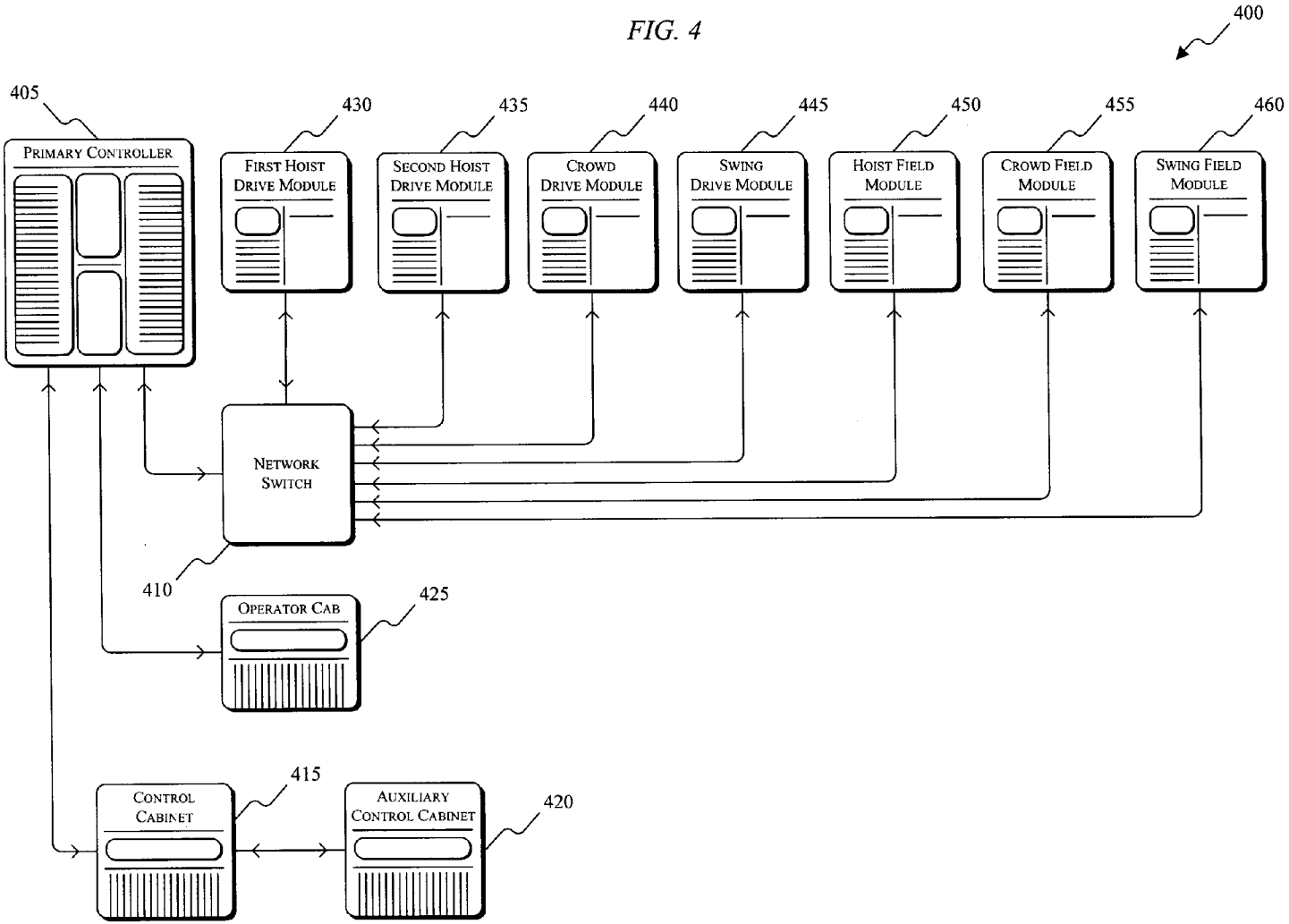
FIG. 4 illustrates a control system for an industrial machine according to an embodiment of the invention.

FIG. 4 illustrates a more detailed control system 400 for the power shovel 10. For example, the power shovel 10 includes a primary controller 405, a network switch 410, a control cabinet 415, an auxiliary control cabinet 420, an operator cab 425, a first hoist drive module 430, a second hoist drive module 435, a crowd drive module 440, a swing drive module 445, a hoist field module 450, a crowd field module 455, and a swing field module 460. The various components of the control system 400 are connected by and communicate through, for example, a fiber-optic communication system utilizing one or more network protocols for industrial automation, such as process field bus ("PROFIBUS"), Ethernet, ControlNet, Foundation Fieldbus, INTERBUS, controller-area network ("CAN") bus, etc. The control system 400 can include the components and modules described above with respect to FIG. 2. For example, the one or more hoist motors and/or drives 215 correspond to first and second hoist drive modules 430 and 435, the one or more crowd motors and/or drives 220 correspond to the crowd drive module 440, and the one or more swing motors and/or drives 225 correspond to the swing drive module 445. The user interface 210 and the indicators 205 can be included in the operator cab 425, etc. The loadpin strain gauge, the inclinometer 110, and the gantry pins can provide electrical signals to the primary controller 405, the controller cabinet 415, the auxiliary cabinet 420, etc.

The first hoist drive module 430, the second hoist drive module 435, the crowd drive module 440, and the swing drive module 445 are configured to receive control signals from, for example, the primary controller 405 to control hoisting, crowding, and swinging operations of the shovel 10. The control signals are associated with drive signals for hoist, crowd, and swing motors 215, 220, and 225 of the shovel 10. As the drive signals are applied to the motors 215, 220, and 225, the outputs (e.g., electrical and mechanical outputs) of the motors are monitored and fed back to the primary controller 405 (e.g., via the field modules 450-460). The outputs of the motors include, for example, motor speed, motor torque, motor power, motor current, etc. Based on these and other signals associated with the shovel 10 (e.g., signals from the inclinometer 110), the primary controller 405 is configured to determine or calculate one or more operational states or positions of the shovel 10 or its components. In some embodiments, the primary controller 405 determines a dipper position, a dipper handle angle or position, a hoist rope wrap angle, a hoist motor rotations per minute ("RPM"), a crowd motor RPM, a dipper speed, a dipper acceleration, etc.

The controller 200 and the control system 400 of the shovel 10 described above are used to implement an intelligent digging control ("IDC") for the shovel 10. IDC is used to dynamically control the application of hoist and crowd forces to increase the productivity of the shovel 10, minimize center-of-gravity ("CG") excursions of the shovel 10, reduce forward and rearward tipping moments of the shovel during a digging operation, and reduce structural fatigue on various components of the shovel 10 (e.g., the mobile base 15, the turntable 25, the machinery deck 30, the lower end 40, etc.).

For example, IDC is configured to dynamically modify a maximum allowable crowd torque based on, among other things, a position of the dipper 70 or dipper 85 and a current or present hoist bail pull level in order to limit the forward and/or rearward tipping moment of the shovel 10. Additionally, IDC is configured to dynamically modify an allowable crowd retract torque (i.e., a deceleration torque, a negative crowd torque, or a regenerative torque in the crowding direction) to reduce crowd motor speed based on a determined acceleration of, for example, the dipper 70 as the dipper 70 impacts a bank.

IDC can be divided into two control operations, referred to herein as balanced crowd control ("BCC") and impact crowd control ("ICC"). BCC and ICC are capable of being executed in tandem or individually by, for example, the controller 200 or the primary controller 405 of the shovel 10. BCC is configured to limit the crowd force (e.g., crowd torque) when hoist bail pull is low to reduce a static tipping moment of the shovel 10. Hoist bail pull is often low when the dipper 70 is in a tuck position prior to the initiation of a digging operation, and then increases when the dipper 70 impacts and penetrates the bank. The crowd force is often increased as the dipper handle 85 is extended to maintain or increase bank penetration. At such a point in the digging cycle, the shovel 10 is susceptible to boom jacking caused by excess crowd reaction forces propagating backward through the dipper handle 85. Boom jacking can result in reduced tension in the boom suspension ropes 50 and can increase the CG excursion associated with a front-to-back or rearward tipping moment. BCC and ICC are configured to be implemented together or individually to reduce or minimize rearward CG excursions and reduce or eliminate boom jacking, as well as reduce the amount of load that is removed from the suspension ropes 50 during the digging operation. By reducing or eliminating boom jacking and retaining tension in the suspension ropes 50, the range of front-to-back or rearward CG excursions (e.g., excursions in a horizontal direction) are decreased or minimized.

An implementation of IDC for the shovel 10 is illustrated with respect to the process 500 of FIGS. 5-8. In the embodiment of the invention provided in FIGS. 5-8, IDC includes both BCC and ICC. Although BCC and ICC are described in combination with respect to the process 500, each is capable of being implemented individually in the shovel 10 or another industrial machine. In some embodiments, BCC is executed using a slower cycle time (e.g., a 100 ms cycle time) compared to the cycle time of ICC (e.g., a 10 ms cycle time). In some embodiments, the cycle time can be dynamically changed or modified during the execution of the process 500.

The process 500 is associated with and described herein with respect to a digging operation and hoist and crowd forces applied during the digging operation. The process 500 is illustrative of an embodiment of IDC and can be executed by the controller 200 or the primary controller 405. Various steps described herein with respect to the process 500 are capable of being executed simultaneously, in parallel, or in an order that differs from the illustrated serial manner of execution. The process 500 is also capable of being executed using fewer steps than are shown in the illustrated embodiment. For example, one or more functions, formulas, or algorithms can be used to calculate a desired crowd torque limit based on a hoist bail pull level, instead of using a number of threshold comparisons. Additionally, in some embodiments, values such as ramp rate (see step 620) and threshold retract factor ("TRF") (see step 575) have fixed or stored values and do not need to be set. In such instances, the setting steps for such values can be omitted from the process 500. The steps of the process 500 related to, for example, determining a dipper handle angle, determining a crowd torque, determining a hoist bail pull, determining a crowd speed, etc., are accomplished using the one or more sensors 240 (e.g., one or more inclinometers, one or more resolvers, one or more drive modules, one or more field modules, one or more tachometers, etc.) that can be processed and analyzed using instructions executed by the controller 200 to determine a value for the characteristic of the shovel 10. As described above, a system such as the P&H® Centurion® system can be used to complete such steps.

The process 500 begins with BCC. BCC can, among other things, increase the shovel's digging capability with respect to hard toes, increase dipper fill factors, prevent the dipper from bouncing off a hard toe, maintain bank penetration early in a digging cycle, reduce the likelihood of stalling in the bank, and smoothen the overall operation of the shovel. For example, without BCC, the amount of crowd torque that is available when digging the toe of the bank can push the dipper 70 against the ground and cancel a portion of the applied hoist bail pull or stall the hoist altogether. Additionally, by increasing the effectiveness of the shovel 10 early in the digging cycle and the ability to penetrate the bank in a hard toe condition, an operator is able to establish a flat bench for the shovel 10. When the shovel 10 is operated from a flat bench, the shovel 10 is not digging uphill and the momentum of the dipper 70 can be maximized in a direction directly toward the bank.

Figure 5:
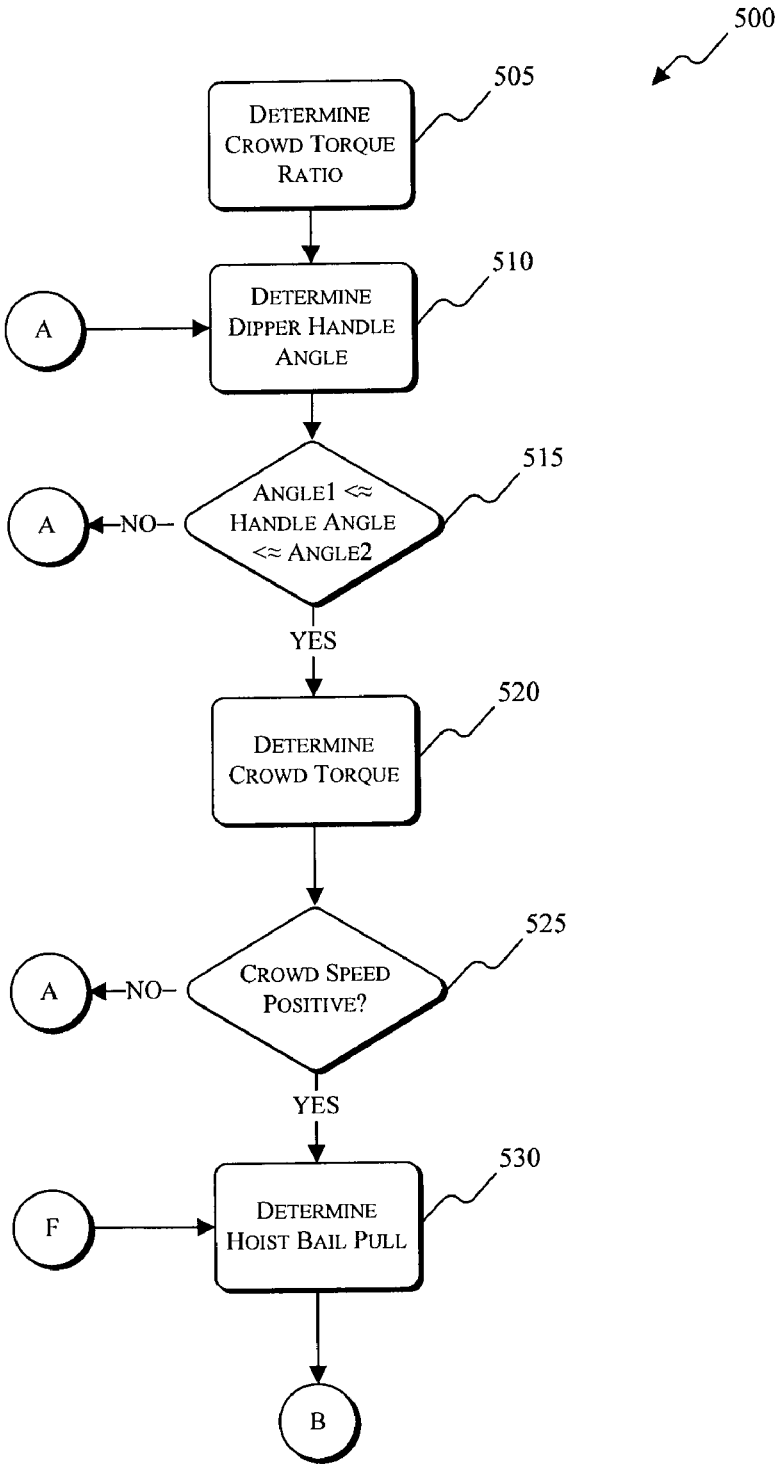
FIGS. 5-9 illustrate a process for controlling an industrial machine according to an embodiment of the invention.
Figure 6:
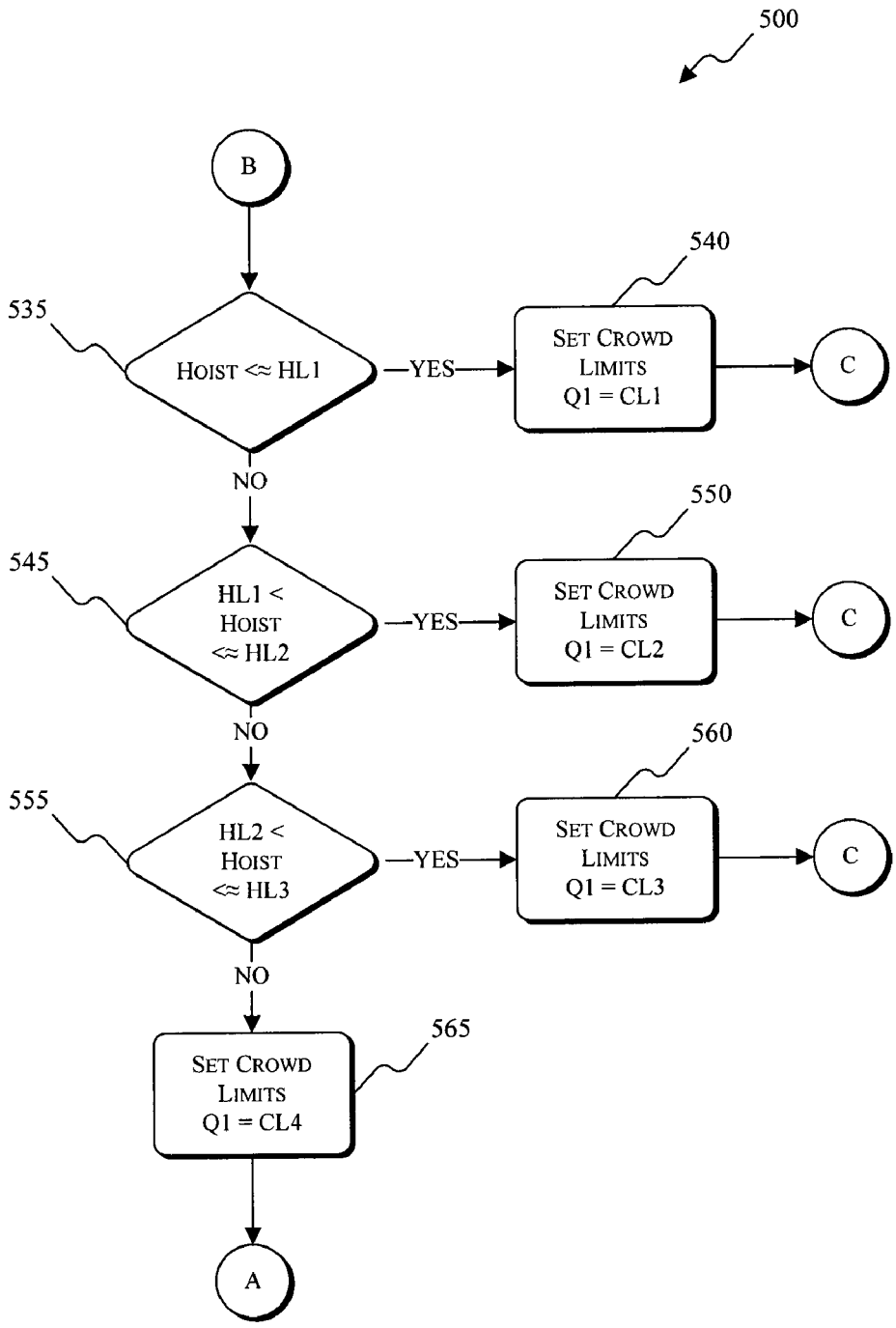

FIGS. 5 and 6 illustrate the BCC section of the process 500 for IDC. At step 505, a crowd torque ratio is determined. The crowd torque ratio represents a ratio of a standard operational value for crowd torque to a torque at which the one or more crowd motors 220 are being operated or limited, as described below. For example the crowd torque ratio can be represented by a decimal value between zero and one. Alternatively, the crowd torque ratio can be represented as a percentage (e.g., 50%), that corresponds to a particular decimal value (e.g., 0.50). The angle of the dipper handle 85 is then determined (step 510). If, at step 515, the angle of the dipper handle 85 is between a first angle limit ("ANGLE1") and a second angle limit ("ANGLE2"), the process 500 proceeds to step 520. If the angle of the dipper handle 85 is not between ANGLE1 and ANGLE2, the process 500 returns to step 510 where the angle of the dipper handle 85 is again determined. ANGLE1 and ANGLE2 can take on values between, for example, approximately 20° and approximately 90° with respect to a horizontal axis or plane extending parallel to a surface on which the shovel 10 is positioned (e.g., a horizontal position of the dipper handle 85). In other embodiments, values for ANGLE1 and ANGLE2 that are less than or greater than 20° or less than or greater than 90°, respectively, can be used. For example, ANGLE1 can have a value of approximately 10° and ANGLE2 can have a value of approximately 90°. ANGLE1 and ANGLE2 are used to define an operational range in which the IDC is active. In some embodiments, ANGLE1 and ANGLE2 are within the range of approximately 0° and approximately 90° with respect to the horizontal plane or a horizontal position of the dipper handle 85.

At step 520, a crowd torque for the one or more crowd motors 220 is determined. The crowd torque has a value that is positive when the dipper handle 85 is being pushed away from the shovel 10 (e.g., toward a bank) and a value that is negative when the dipper handle is being pulled toward the shovel 10 (e.g., away from the bank). The sign of the crowd torque value is independent of, for example, the direction of rotation of the one or more crowd motors 220. For example, a rotation of the one or more crowd motors 220 that results in the dipper handle 85 crowding toward a bank is considered to be a positive rotational speed, and a rotation of the one or more crowd motors 220 that results in the dipper handle 85 retracting toward the shovel 10 is considered to be a negative rotational speed. If the rotational speed of the one or more crowd motors 220 is positive (i.e., greater than zero), the dipper handle 85 is crowding toward a bank. If the crowd speed is negative (i.e., less than zero), the dipper handle 85 is being retracted toward the shovel 10. However, the crowd torque of the one or more crowd motors 220 can be negative when extending the dipper handle 85 and can be positive when retracting the dipper handle 85. If, at step 525, the crowd torque is negative, the process returns to step 510 where the angle of the dipper handle 85 is again determined. If, at step 525, the crowd speed is positive, the process proceeds to step 530. In other embodiments, a different characteristic of the shovel 10 (e.g., a crowd motor current) can be used to determine, for example, whether the dipper handle 85 is crowding toward a bank or being retracted toward the shovel 10, as described above. Additionally or alternatively, the movement of the dipper 70 can be determined as being either toward the shovel 10 or away from the shovel 10, one or more operator controls within the operator cab of the shovel 10 can be used to determine the motion of the dipper handle 85, one or more sensors associated with the saddle block 90 can be used to determine the motion of the dipper handle 85, etc.

After the dipper handle 85 is determined to be crowding toward a bank, a level of hoist bail pull is determined (step 530). The level of hoist bail pull is determined, for example, based on one or more characteristics of the one or more hoist motors 215. The characteristics of the one or more hoist motors 215 can include a motor speed, a motor voltage, a motor current, a motor power, a motor power factor, etc. After the hoist bail pull is determined, the process 500 proceeds to section B shown in and described with respect to FIG. 6.

At step 535 in FIG. 6, the determined hoist bail pull is compared to a first hoist bail pull level or limit ("HL1"). If the determined hoist bail pull is less than or approximately equal to HL1, the crowd torque limit for a crowd extend operation is set equal to a first crowd torque limit value ("CL1") (step 540). The notation "Q1" is used herein for a crowd extend operation to identify an operational mode of the shovel 10 in which a torque of the one or more crowd motors 220 is positive (e.g., the dipper 70 is being pushed away from the shovel 10) and a speed of the one or more crowd motors 220 is positive (e.g., the dipper 70 is moving away from the shovel 10). After the crowd torque limit has been set at step 540, the process 500 proceeds to section C shown in and described with respect to FIG. 7. If, at step 535, the hoist bail pull is not less than or approximately equal to HL1, the hoist bail pull is compared to a second hoist bail pull level or limit ("HL2") (step 545) to determine if the hoist bail pull is between HL1 and HL2. If the determined hoist bail pull is less than or approximately equal to HL2 and greater than HL1, the crowd torque limit, Q1, is set equal to a second crowd torque limit value ("CL2") (step 550). After the crowd torque limit has been set at step 550, the process 500 proceeds to section C in FIG. 7. If, at step 545, the hoist bail pull is not less than or approximately equal to HL2, the hoist bail pull is compared to a third hoist bail pull level or limit ("HL3") (step 555) to determine if the hoist bail pull is between HL2 and HL3. If the determined hoist bail pull is less than or approximately equal to HL3 and greater than HL2, the crowd torque limit, Q1, is set equal to a third crowd torque limit value ("CL3") (step 560). After the crowd torque limit has been set at step 560, the process 500 proceeds to section C in FIG. 7. If, at step 555, the hoist bail pull is not less than or approximately equal to HL3, the crowd torque limit, Q1, is set equal to a fourth crowd torque limit value ("CL4") (step 565). After the crowd torque limit has been set at step 565, the process 500 returns to step 510 in section A (FIG. 5) where the dipper handle angle is again determined.

The first, second, and third hoist bail pull levels HL1, HL2, and HL3 can be set, established, or predetermined based on, for example, the type of industrial machine, the type or model of shovel, etc. As an illustrative example, the first hoist bail pull level, HL1, has a value of approximately 10% of standard hoist (e.g., approximately 10% of a standard or rated operating power or torque for the one or more hoist motors 220), the second hoist bail pull level, HL2, has a value of approximately 22% of standard hoist, and the third hoist bail pull level, HL3, has a value of approximately 50% of standard hoist. In other embodiments, HL1, HL2, and HL3 can have different values (e.g., HL1≈20%, HL2≈40%, HL3≈60%). However, regardless of the actual values that HL1, HL2, and HL3 take on, the relationship between the relative magnitudes of the limits remain the same (i.e., HL1<≈HL2<≈HL3). In some embodiments of the invention, two or more than three hoist bail pull levels are used to set crowd torque limits (e.g., four, five, six, etc.). The number of hoist bail pull levels is set based on a level of control precision that is desired. For example, a gradual increase in the crowd torque setting can be achieved by increasing the number of hoist bail pull levels to which the actual hoist bail pull is compared. In some embodiments, the hoist bail pull levels are set based on the crowd torque limits to ensure that a sufficient hoist bail pull is applied to the dipper 70 to counteract a loss in suspension rope tension that results from the crowd torque. For example, the hoist bail pull levels and crowd torque limits are balanced such that not more than approximately 30% of suspension rope tension is lost during the digging operation. In some embodiments, if crowd torque is too high with respect to hoist bail pull, the hoist bail pull can fight the crowd torque and decreases the productivity of the shovel 10.

The crowd torque limits CL1, CL2, CL3, and CL4 can also have a variety of values. As an illustrative example, CL1, CL2, CL3, and CL4 increase up to a standard crowd torque (e.g., based on a percent of standard operating power or torque for the one or more crowd motors 220) as hoist bail pull increases. In one embodiment, CL1≈18%, CL2≈54%, CL3≈100%, and CL4≈100%. In other embodiments, CL1, CL2, CL3 and CL4 can take on different values. However, regardless of the values that CL1, CL2, CL3, and CL4 take on, the relationship between the relative magnitudes of the limits remain the same (e.g., CL1<≈CL2<≈CL3<≈CL4). Additionally, as described above with respect to hoist bail pull levels, additional or fewer crowd torque limits can be used. For example, the number of crowd torque limits that are used are dependent upon the number of hoist bail pull levels that are used to control the shovel 10 (e.g., the number of crowd torque limits=the number of hoist bail levels+1). In some embodiments, the crowd torque limits are set as a percentage or ratio of hoist bail pull level or as a function of the hoist bail pull level.

After the crowd torque limit is set as described above, the process 500 enters the ICC section in which the acceleration (e.g., a negative acceleration or deceleration) of the dipper 70 or dipper handle 85 is monitored in order to mitigate the effects of the dipper impacting the bank (e.g., in hard toe conditions) and to reduce dynamic tipping moments of the shovel 10. For example, if the dipper 70 is stopped rapidly in the crowding direction by the bank (e.g., a hard toe), the kinetic energy and rotational inertia in the one or more crowd motors 220 and crowd transmission must be dissipated. In conventional shovels, this kinetic energy is dissipated by jacking the boom, which results in a rearward tipping moment and CG excursion of the shovel 10. In order to prevent or mitigate the rearward tipping moment, the kinetic energy of the one or more crowd motors 220 is dissipated another way. Specifically, ICC is configured to monitor the acceleration of, for example, the dipper 70, the dipper handle 85, etc. When an acceleration (e.g., a negative acceleration or a deceleration) that exceeds a threshold acceleration value or retract factor (described below) is achieved, a reference speed is set (e.g., equal to zero), and a maximum allowable retract torque for the one or more crowd motors 220 is increased. Although the direction of motion of the dipper handle 85 may not reverse, the retract torque applied to the one or more crowd motors 220 can dissipate the forward kinetic energy of the one or more crowd motors 220 and the crowd transmission. By dissipating the kinetic energy of the one or more crowd motors 220, the rearward tipping moment of the shovel 10 when impacting the back is reduced or eliminated.

Figure 7:
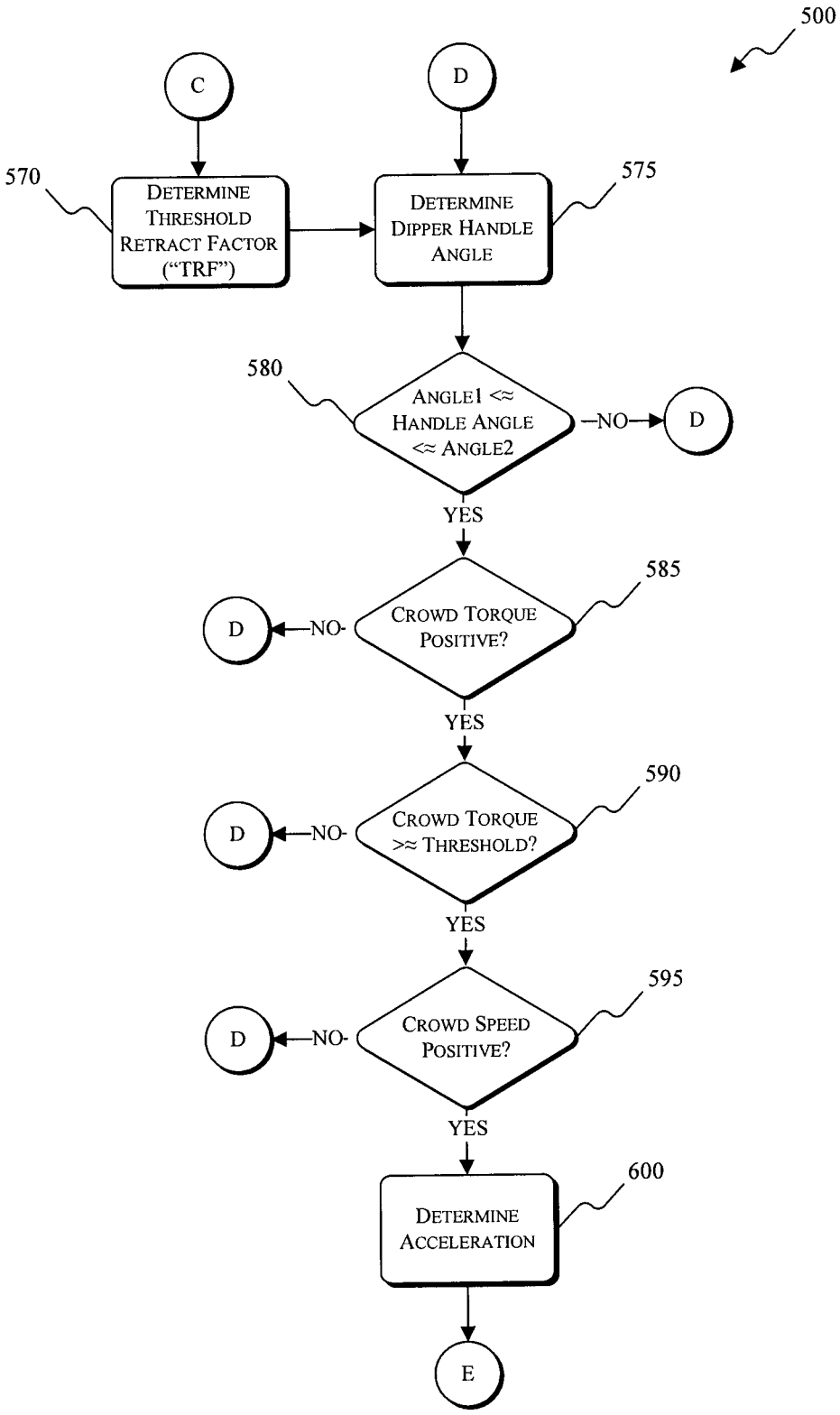
Figure 8:
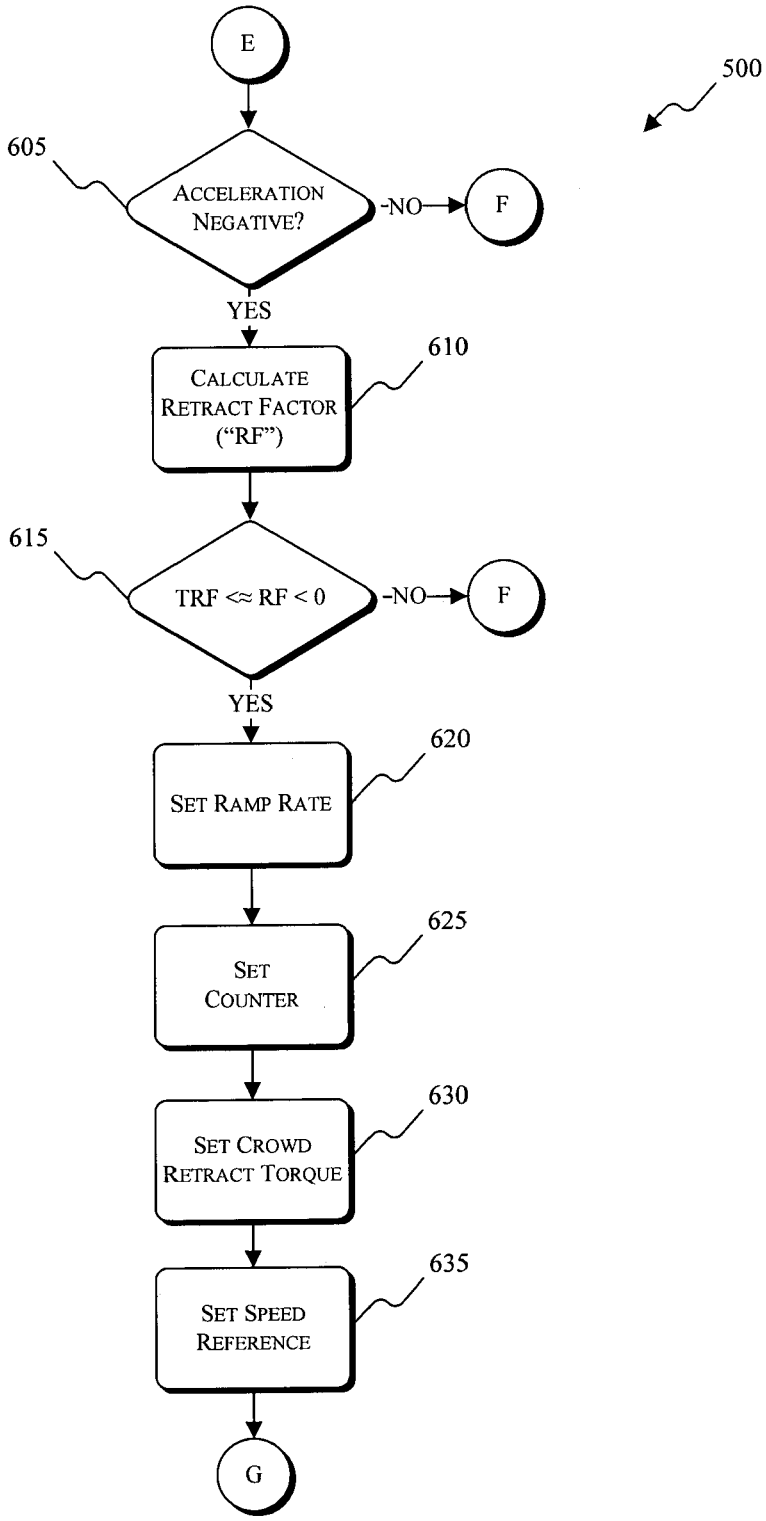

FIGS. 7 and 8 illustrate the ICC section of the process 500 for IDC. At step 570, a threshold retract factor ("TRF") is determined. The TRF can be, for example, retrieved from memory (e.g., the memory 255), calculated, manually set, etc. The TRF can have a value of, for example, between approximately −300 and approximately −25. In some embodiments, a different range of values can be used for the TRF (e.g., between approximately 0 and approximately −500). The negative sign on the TRF is indicative of an acceleration in a negative direction (e.g., toward the shovel 10) or a deceleration of the dipper 70. The TRF can be used to determine whether the dipper 70 has impacted the bank and whether ICC should be initiated to dissipate the kinetic energy of the one or more crowd motors 220 and crowd transmission. In some embodiments the TRF is a threshold acceleration value associated with the acceleration of the dipper 70, the dipper handle 85, etc. Modifying the TRF controls the sensitivity of ICC and the frequency with which the one or more crowd motors 220 will be forced to a zero speed reference upon the dipper 70 impacting the bank. The more sensitive the setting the more frequently the one or more crowd motors 220 will be forced to a zero speed reference because ICC is triggered more easily at lower acceleration events. Setting the TRF can also include setting a time value or period, T, for which the speed reference is applied. In some embodiments, the time value, T, can be set to a value of between 0.1 and 1.0 seconds. In other embodiments, the time value, T, can be set to a value greater than 1.0 seconds (e.g., between 1.0 and 2.0 seconds). The time value, T, is based on an estimated or anticipated duration of a dynamic event (e.g., following the impact of the dipper 70 with the bank). In some embodiments, the time value, T, is based on one or more operator tolerances to the resulting lack of operator control. After the TRF has been set, the angle of the dipper handle 85 is again determined (step 575). The angle of the dipper handle 85 is then compared to a first dipper handle angle threshold value ("ANGLE1") and a second dipper handle angle threshold value ("ANGLE2") (step 580). The first dipper handle angle threshold value, ANGLE1, and the second dipper handle angle threshold value, ANGLE2, can have any of a variety of values. For example, in one embodiment, ANGLE1 has a value of approximately 40° with respect to a horizontal plane (e.g., a horizontal plane parallel to the ground on which the shovel 10 is positioned) and ANGLE2 has a value of approximately 90° with respect to the horizontal plane (e.g., the dipper handle is orthogonal with respect to the ground). In some embodiments, the values of ANGLE1 and ANGLE2 have different values within the range of approximately 0° with respect to the horizontal plane and approximately 90° with respect to the horizontal plane.

If the angle of the dipper handle 85 is greater than or approximately equal to ANGLE1 and less than or approximately equal to ANGLE2, the process 500 proceeds to step 585. If the angle of the dipper handle 85 is not greater than or approximately equal to ANGLE1 and less than or approximately equal to ANGLE2, the process 500 returns to section D and step 575 where the angle of the dipper handle is again determined. At step 585, the controller 200 or primary controller 405 determines whether the crowd torque is positive. As described above, crowd torque can be either positive or negative regardless of the direction of motion of the dipper handle 85. For example, as the dipper handle 85 is crowding toward the bank, the dipper is being pulled away from the shovel 10 as a result of gravity. In such an instance, the crowd speed is positive (i.e., moving away from the shovel 10) and the crowd torque is negative (slowing down the dipper which is pulling away from the shovel 10 as a result of gravity). However, when the dipper 70 initially impacts the bank, the dipper handle 85 may continue to move forward (i.e., crowd speed positive), but now the force from the impact with the bank is causing the dipper handle 85 to push toward the bank to resist this reaction and maintain positive crowd speed (i.e., crowd torque is positive). If the crowd torque is negative, the process 500 returns to section D and step 575. If the crowd torque is positive, the process 500 proceeds to step 590 where the crowd torque is compared to a crowd torque threshold value.

The crowd torque threshold value can be set to, for example, approximately 30% of standard crowd torque. In some embodiments, the crowd torque threshold value is greater than approximately 30% of standard crowd torque (e.g., between approximately 30% and approximately 100% standard crowd torque). In other embodiments, the crowd torque threshold value is less than approximately 30% of standard crowd torque (e.g., between approximately 0% and approximately 30% of standard crowd torque). The crowd torque threshold value is set to a sufficient value to, for example, limit the number of instances in which ICC is engaged while still reducing the CG excursions of the shovel 10. If, at step 590, the controller 200 determines that crowd torque is not greater than or approximately equal to the crowd torque threshold, the process 500 returns to section D and step 575. If the crowd torque is greater than or approximately equal to the crowd torque threshold value, the process 500 proceeds to step 595. At step 595, the controller 200 determines whether the crowd speed is positive (e.g., moving away from the shovel 10). If the crowd speed is not positive, the process 500 returns to section D and step 575. If the crowd speed is positive, an acceleration (e.g., a negative acceleration or deceleration) of the shovel 10 is determined (step 600). The acceleration of the shovel 10 is, for example, the acceleration of the dipper 70, an acceleration of the dipper handle 85, etc. The acceleration is determined using, for example, signals from the one or more sensors 240 (e.g., one or more resolvers) which can be used by the controller 200 to calculate, among other things, a position of the dipper 70 or the dipper handle 85, a speed of the dipper 70 or dipper handle 85, and the acceleration of the dipper 70 or dipper handle 85. In some embodiments, the determined acceleration can be filtered to prevent any acceleration spikes or measurement errors from affecting the operation of ICC. After the acceleration has been determined, the process 500 proceeds to section E shown in and described with respect to FIG. 8.

With reference to FIG. 8, the controller 200 determines whether the acceleration determined at step 600 of the process 500 is negative (step 605). If the acceleration is not negative, the process 500 returns to section F and step 530 shown in and described with respect to FIG. 5. If the acceleration is negative, a retract factor ("RF") (e.g., a deceleration factor, a negative acceleration factor, etc.) is calculated (step 610). The retract factor, RF, is used to determine whether the negative acceleration (i.e., deceleration) of the dipper 70 or dipper handle 85 is sufficient in magnitude for ICC to be initiated. In some embodiments, the retract factor, RF, is calculated as a ratio of crowd motor torque to the determined acceleration. In other embodiments, the retract factor, RF, is calculated as a ratio of an estimated torque to an actual torque or a predicted acceleration to the actual acceleration. In some embodiments, an average of determined accelerations can be used to calculate the retract factor, RF. In some embodiments the RF is an acceleration value associated with the acceleration of the dipper 70, the dipper handle 85, etc. Regardless of the precise factors used to calculate the retract factor, RF, the retract factor, RF, can be compared to the threshold retract factor, TRF (step 615). If the retract factor, RF, is greater than or approximately equal to the threshold retract factor, TRF, and less than zero, the process 500 proceeds to step 620. If the retract factor, RF, is not greater than or approximately equal to the threshold retract factor, TRF, and less than zero, the process 500 returns to section F shown in and described with respect to FIG. 5.

At step 620, a ramp rate is set. The ramp rate is, for example, a set time during which the crowd motor drive or crowd drive module 440 is to change the speed of the one or more crowd motors 220 from a current or present speed value to a new speed value. As such, the ramp rate can affect the ability of the shovel 10 to dampen a dynamic event (e.g., the dipper 70 impacting the bank). If the ramp rate is not appropriate for allowing the crowd drive module 440 to achieve a desired change in speed, the shovel 10 is not able to properly dampen the dynamic event. In some embodiments, the higher the ramp rate the slower the speed response to the dynamic event. As such, at step 620, the ramp rate is set sufficiently small to ensure that the shovel 10 is able to dampen the dynamic event. For example, the ramp rate is set based on a motor speed, a motor torque, a dipper speed, a dipper acceleration, one or more limits of the crowd drive 440, one or more limits of the one or more crowd motors 220, etc. In some embodiments, the ramp rate is constant (e.g., linear). In other embodiments, the ramp rate can dynamically vary with respect to, for example, time, motor speed, etc.

Following step 620, a counter or another suitable timer is set (step 625). For example, the counter is set to monitor or control the amount of time that a new crowd retract torque and speed reference are set or applied (described below). In some embodiments, the counter is incremented for each clock cycle of the processing unit 250 until it reaches a predetermined or established value (e.g., the time value, T). The crowd retract torque is then set at step 630.

During normal operation, the crowd retract torque of the one or more crowd motors is set to, for example, approximately 90% of a standard value or normal operating limit (i.e., 100%). However, during a dynamic event such as the dipper 70 impacting the bank, a retract torque of 90-100% of a normal operating limit is often insufficient to dissipate the kinetic energy of the one or more crowd motors 220 and the crowd transmission to prevent boom jacking As such, at step 630, the crowd retract torque is set to a value that exceeds the standard value or normal operating limit for the one or more crowd motors 220 retract torque. In some embodiments, the retract torque is set to approximately 150% of the normal operational limit for retract torque. In other embodiments, the retract torque is set to a value of between approximately 150% and approximately 100% of the normal operational limit for retract torque. In still other embodiments, the retract torque is set to greater than approximately 150% of the normal operation limit for retract torque. In such embodiments, the retract torque is limited by, for example, operational characteristics of the motor (e.g., some motors can allow for greater retract torques than others). As such, the retract torque is capable of being set to a value of between approximately 150% and approximately 400% of the normal operational limit based on the characteristics of the one or more crowd motors 220. In some embodiments, the retract torque or crowd retract torque is set in a direction corresponding to the direction of the determined acceleration. For example, an acceleration in the negative direction (i.e., toward the shovel) or, alternatively, a deceleration in the direction of crowding (i.e., away from the shovel) results in setting a crowd torque (e.g., a negative crowd torque, a deceleration torque, a regenerative torque, etc.) or negative motor current.

After the crowd retract torque is set at step 630, a speed reference is set (step 635). The speed reference is a desired future speed (e.g., zero) of the one or more crowd motors 220 that is selected or determined to dissipate the kinetic energy of the one or more crowd motors 220 and crowd transmission. When the speed reference is set, the damping of the dynamic event (e.g., the dipper impacting the bank) is automatically executed to dissipate the kinetic energy of the one or more crowd motors 220 and the crowd transmission. The speed reference is set (e.g., to zero) for the time value, T, to dissipate the kinetic energy of the one or more crowd motors 220 and the crowd transmission, as described above. In some embodiments, the speed reference can be dynamic and change throughout the time value, T (e.g., change linearly, change non-linearly, change exponentially, etc.). In other embodiments, the speed reference can be based on, for example, a difference between an actual speed and a desired speed, an estimated speed, or another reference speed. Following step 635, the process 500 proceeds to section G shown in and described with respect to FIG. 9.

Figure 9:
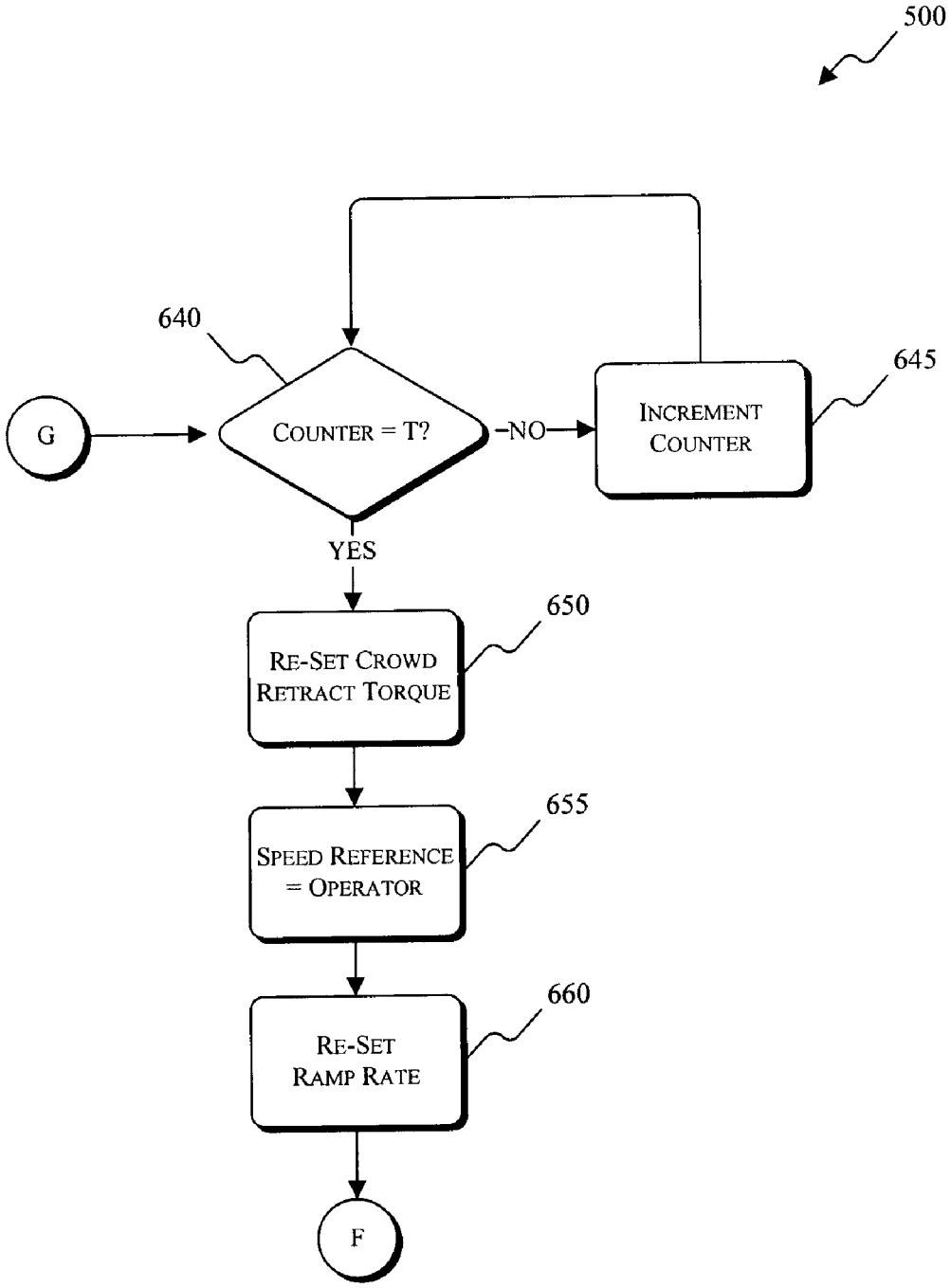

At step 640 in FIG. 9, the counter is compared to the time value, T. If the counter is not equal to the time value, T, the counter is incremented (step 645), and the process 500 returns to step 640. If, at step 640, the counter is equal to the time value, T, the crowd retract torque is re-set back to the standard value or within the normal operational limit of the motor (e.g., crowd retract torque $\leq\approx$100%) (step 650), the speed reference is set equal to an operator's speed reference (e.g., based on a control device such as a joystick) (step 655), and the ramp rate is re-set to a standard value for the operation of the shovel 10 (step 660). After the ramp rate has been re-set, the process 500 returns to section F shown in and described with respect to FIG. 5. In some embodiments, the controller 200 or primary controller 405 can also monitor the position of the dipper handle 85 or the dipper 70 with respect to the bank and slow the motion of the dipper handle 85 or the dipper 70 prior to impacting the bank to reduce the kinetic energy associated with the one or more crowd motors 220 and the crowd transmission.

Thus, the invention provides, among other things, systems, methods, devices, and computer readable media for controlling one or more crowd torque limits of an industrial machine based on hoist bail pull and a deceleration of a dipper. Various features and advantages of the invention are set forth in the following claims.

What is claimed is:

1. A method of controlling a digging operation of an industrial machine, the industrial machine including a dipper handle and a crowd motor drive, the method comprising:

determining an angle of the dipper handle;

comparing the angle of the dipper handle to one or more dipper handle angle limits;

determining a hoist bail pull;

comparing the hoist bail pull to one or more hoist bail pull limits; and setting a crowd torque limit for the crowd motor drive based on the comparison of the angle of the dipper handle to the one or more dipper handle angle limits and the comparison of the hoist bail pull to the one or more hoist bail pull limits, wherein setting the crowd torque limit includes setting the crowd torque limit to a first crowd torque limit when the hoist bail pull is less than or approximately equal to a first of the one or more hoist bail pull limits, and setting the crowd torque limit to a second crowd torque limit when the hoist bail pull is greater than the first of the one or more hoist bail pull limits.

2. The method of claim 1, wherein the crowd torque limit increases as the hoist bail pull increases.

3. The method of claim 1, wherein the one or more dipper handle angle limits are between approximately zero degrees and approximately ninety degrees with respect to a horizontal position of the dipper handle.

4. The method of claim 1, wherein setting the crowd torque limit includes setting the crowd torque limit to a first crowd torque limit when the hoist bail pull is less than or approximately equal to a first of the one or more hoist bail pull limits, and setting the crowd torque limit to a second crowd torque limit when the hoist bail pull is greater than the first of the one or more hoist bail pull limits.

5. The method of claim 1, wherein the second crowd torque limit is greater than the first crowd torque limit.

6. The method of claim 1, wherein the industrial machine is a rope shovel.

7. An industrial machine comprising:

a dipper handle connected to a dipper;

a crowd motor drive configured to provide one or more control signals to a crowd motor, the crowd motor operable to provide a force to the dipper handle to move the dipper handle toward or away from a bank; and a controller connected to the crowd motor drive, the controller configured to determine an angle of the dipper handle, compare the angle of the dipper handle to one or more dipper handle angle limits, determine a hoist bail pull, compare the hoist bail pull to one or more hoist bail pull limits, and set a crowd torque limit for the crowd motor drive based on the comparison of the angle of the dipper handle to the one or more dipper handle angle limits and the comparison of the hoist bail pull to the one or more hoist bail pull limits, wherein setting the crowd torque limit includes setting the crowd torque limit to a first crowd torque limit when the hoist bail pull is less than or approximately equal to a first of the one or more hoist bail pull limits, and setting the crowd torque limit to a second crowd torque limit when the hoist bail pull is greater than the first of the one or more hoist bail pull limits.

8. The industrial machine of claim 6, wherein the one or more dipper handle angle limits are between approximately zero degrees and approximately ninety degrees with respect to a horizontal position of the dipper handle.

9. The industrial machine of claim 6, wherein the second crowd torque limit is greater than the first crowd torque limit.

10. The industrial machine of claim 6, wherein the industrial machine is a rope shovel.

11. A method of controlling a digging operation of an industrial machine, the method comprising:

determining a hoist bail pull associated with the industrial machine;

determining a crowd torque limit value for a crowd drive based on the determined hoist bail pull of the industrial machine; and setting a crowd torque limit of the crowd drive to the crowd torque limit value to limit a torque associated with a crowding operation to the crowd torque limit value, wherein determining a crowd torque limit includes comparing the determined hoist bail pull to one or more hoist bail pull limils, and wherein setting the crowd torque limit includes setting the crowd torque limit to a first crowd torque limit when the determined hoist bail pull is less than or approximately equal to a first of the one or more hoist bail pull limits, and selling the crowd torque limit to a second crowd torque limit when the determined hoist bail pull is greater than the first of the one or more hoist bail pull limits.

12. The method of claim 11, further comprising determining an angle of a dipper handle; and comparing the angle of the dipper handle to one or more dipper handle angle limits.

13. The method of claim 12, wherein the one or more dipper handle angle limits are between approximately zero degrees and approximately ninety degrees with respect to a horizontal position of the dipper handle.

14. The method of claim 11, wherein the second crowd torque limit is greater than the first crowd torque limit.

15. The method of claim 11, wherein the crowd torque limit is a function of the determined hoist bail pull.

16. The method of claim 15, wherein the crowd torque limit increases as the determined hoist bail pull increases.

* * * * *

UNITED STATES PATENT AND TRADEMARK OFFICE

CERTIFICATE OF CORRECTION

PATENT NO. : 8,359,143 B2
APPLICATION NO. : 13/472138
DATED : January 22, 2013
INVENTOR(S) : Joseph Colwell et al.

It is certified that error appears in the above-identified patent and that said Letters Patent is hereby corrected as shown below:

In the Claims:

Column 18, Line 44 of Claim 11: Replace the word [selling] with --setting--

Signed and Sealed this
Fourth Day of June, 2013

Teresa Stanek Rea
*Acting Director of the United States Patent and Trademark Office*